US006511542B2

(12) United States Patent
Inagaki

(10) Patent No.: US 6,511,542 B2
(45) Date of Patent: Jan. 28, 2003

(54) APPARATUS AND METHOD FOR PRODUCING ELECTROPHOTOGRAPHIC PHOTORECEPTOR

(75) Inventor: Keiichi Inagaki, Itami (JP)

(73) Assignee: Minolta Co., Ltd., Osaka (JP)

( * ) Notice: Subject to any disclaimer, the term of this patent is extended or adjusted under 35 U.S.C. 154(b) by 175 days.

(21) Appl. No.: 09/768,573

(22) Filed: Jan. 25, 2001

(65) Prior Publication Data

US 2001/0009748 A1 Jul. 26, 2001

(30) Foreign Application Priority Data

Jan. 26, 2000 (JP) ..... 2000-016637
Dec. 6, 2000 (JP) ..... 2000-371812

(51) Int. Cl.[7] ..... B05C 3/02
(52) U.S. Cl. ..... 118/404; 118/602; 118/412
(58) Field of Search ..... 118/404, 412, 118/602, DIG. 11, DIG. 19, 411, 428, 429

(56) References Cited

U.S. PATENT DOCUMENTS 5,244,697 A 9/1993 Vackier et al.
5,707,449 A 1/1998 Ohira et al.
5,849,454 A 12/1998 Tada et al.

FOREIGN PATENT DOCUMENTS

JP 10-105855 4/1998

*Primary Examiner*—Brenda A. Lamb
(74) *Attorney, Agent, or Firm*—Burns, Doane, Swecker & Mathis, LLP

(57) ABSTRACT

An inventive apparatus for producing electrophotographic photoreceptor includes a guide portion permitting passage of a cylindrical coated member; a coating-solution feed portion disposed around an outer periphery of the guide portion and allowing a coating solution to flow over an upper end of the guide portion thereby applying the solution to an outer periphery of the coated member; a coating-solution feeding assembly for feeding the coating solution to the coating-solution feed portion; a coating-solution recovery portion disposed around an outer periphery of the coating-solution feed portion via a partitioning wall for recovery of the coating solution flowing from the coating-solution feed portion over the partitioning wall; and an openable communicating portion for communication between the coating-solution feed portion and the coating-solution recovery portion.

15 Claims, 9 Drawing Sheets

APPARATUS AND METHOD FOR PRODUCING ELECTROPHOTOGRAPHIC PHOTORECEPTOR

BACKGROUND OF THE INVENTION

This application is based on applications No. 16637/2000 and 371812/2000 filed in Japan, the contents of which are hereby incorporated by reference.

1. Field of the Invention

The present invention relates to an apparatus and method for producing an electrophotographic photoreceptor for use in electrophotographic apparatuses such as copiers, printers and the like. Particularly, the invention relates to the apparatus and method for producing electrophotographic photoreceptor wherein a coating solution is applied to an outer periphery of a cylindrical coated member.

2. Description of the Related Art

The electrophotographic apparatuses, such as copiers and printers, have conventionally employed the electrophotographic photoreceptors.

The usual practice heretofore followed in producing the electrophotographic photoreceptor has been to apply to the outer periphery of the coated member a variety of coating solutions including a photosensitive layer coating solution.

Various methods have conventionally been used for applying to the outer periphery of the coated member the various coating solutions including the photosensitive layer solution. It has been a general practice to use a dip coating apparatus such as shown in FIGS. 1(A) and 1(B).

In the dip coating apparatus shown in FIGS. 1(A) and 1(B), a coating solution 2 contained in a tank 1 is introduced by a pump 4 through a feed pipe 4 to a filter 5 so that the filter 5 may remove foreign substances from the coating solution 2. Subsequently, the resultant coating solution 2 is pumped into a dip coating vessel 6 via the feed pipe 4.

A cylindrical coated member 10 is dipped in the coating solution 2 in the dip coating vessel 6 to a predetermined depth while an overflow of the solution 2 from the dip coating vessel 6 is recovered by a solution recovery portion 7. The recovered solution 2 is returned to the tank 1 via a return pipe 8. On the other hand, the coated member 10 thus dipped in the coating solution 2 is withdrawn therefrom at a predetermined rate whereby the coating solution 2 is applied to the outer periphery of the coated member 10 in a predetermined thickness.

Where the coating solution 2 is applied to the outer periphery of the coated member 10 by dipping the coated member 10 in the coating solution 2 in the dip coating vessel 6, the coated member 10 must be sealed at its upper end before dipped into the coating solution in order to prevent the coating solution 2 from adhering to an inner periphery of the coated member 10. Unfortunately, this involves cumbersome operations.

If the rate at which the coated member 10 is dipped in the coating solution 2 is increased, air enters the coating solution 2 to produce air bubbles which will adhere to the outer periphery of the coated member 10, causing thickness non-uniformities in the coated layer. Hence, the productivity is lowered because of the inability to increase the rate at which the coated member 10 is dipped in the coating solution 2.

More recently, a first charge transport layer and a second charge transport layer with various additives added thereto are laid over the outer periphery of the coated member 10 in order to enhance various performances of the electrophotographic photoreceptor.

A process for forming the first and second charge transport layers on the outer periphery of the coated member 10 encounters the following problem if the formation of the first charge transport layer on the outer periphery of the coated member 10 is followed by the application of the coating solution 2 for second charge transport layer to the first charge transport layer, the application done by dipping the coated member 10 in the coating solution 2 for second charge transport layer and then withdrawing therefrom the coated member. That is, a part of the first charge transport layer is caused to run as dissolved by the coating solution for second charge transport layer, disabling the production of the electrophotographic photoreceptor with stable characteristics.

There have, in recent times, been proposed a spray coating process wherein the coating solution is applied to the outer periphery of the coated member by spraying the solution onto the outer periphery thereof, and a ring coating process wherein the coating solution is supplied through a periphery of a guide portion for applying the solution to the outer periphery of the coated member passed through the guide portion, as taught in Japanese Unexamined Patent Publication No.10(1998)-104855.

However, the following problems exist with the spray coating process wherein the coating solution is sprayed onto the outer periphery of the coated member. That is, the loss of coating solution is great. Additionally, air bubbles are prone to enter the solution coated over the outer periphery of the coated member. Besides, it is difficult to lay a uniform coating of the solution over the outer periphery of the coated member.

In the ring coating process wherein the coating solution is supplied through the periphery of the guide portion for applying the solution to the outer periphery of the coated member passed through the guide portion, the absence of the coated member in the guide portion results in spilt coating solution. For this reason, the ring coating process is adapted for continuous introduction of the coated members into the guide portion. However, if the coated members are not introduced into the guide portion in accurate alignment, the outer peripheries of the coated members are differently coated with the solution so that electrophotographic photoreceptors of steady characteristics cannot be obtained.

Furthermore, the spray coating process and ring coating process lay the solution coating on the overall area of the outer periphery of the coated member so that the photosensitive layer is formed on the overall area of the outer periphery of the coated member.

Unfortunately, when a gap between the electrophotographic photoreceptor thus fabricated and a developing roller is adjusted using rollers pressed against opposite ends of the photoreceptor, a cumbersome operation is required for peeling off the layer at opposite ends of the photoreceptor in order to prevent the gap between the photoreceptor and the developing roller from being varied due to gradual wear of the layer at the opposite ends of the photoreceptor.

SUMMARY OF THE INVENTION

A first object of the invention is to accomplish a uniform and efficient application of the coating solution to the outer periphery of the cylindrical coated member.

A second object of the invention is to ensure a stable production of electrophotographic photoreceptors of steady characteristics by preventing the dissolution of a previously formed layer on the outer periphery of the coated member when the layer is applied with the coating solution.

The foregoing objects are accomplished in accordance with the invention by providing an apparatus for producing electrophotographic photoreceptor which applies a coating solution to an outer periphery of a cylindrical coated member and comprises: a guide portion permitting passage of the coated member therethrough; a coating-solution feed portion disposed around an outer periphery of the guide portion and allowing the coating solution to flow over an upper end of the guide portion thereby applying the solution to the outer periphery of the coated member; a coating-solution feeding assembly for feeding the coating solution to the coating-solution feed portion; a coating-solution recovery portion disposed around an outer periphery of the coating-solution feed portion via a partitioning wall for recovery of the coating solution flowing from the coating-solution feed portion over the partitioning wall; and an openable communicating portion for communication between the coating-solution feed portion and the coating-solution recovery portion.

Such an apparatus for producing electrophotographic photoreceptor is used to apply the coating solution to the outer periphery of the coated member in the following manner. When the cylindrical coated member is passed through the guide portion, the coating-solution feeding assembly operates to feed the solution to the coating-solution feed portion while the communicating portion for communication between the solution feed portion and the solution recovery portion is closed so that the solution flows from the coating-solution feed portion, around the outer periphery of the guide portion, over the upper end of the guide portion. Such an overflow of the solution over the upper end of the guide portion is applied to the outer periphery of the coated member passed through the guide portion. On the other hand, an excessive coating solution flowing over the partitioning wall is recovered by the coating-solution recovery portion around the outer periphery of the coating-solution feed portion.

When, on the other hand, the coating solution is not applied to the outer periphery of the coated member, the communicating portion is opened to establish the communication between the coating-solution feed portion and the coating-solution recovery portion. With the communicating portion thus opened, the coating solution fed to the coating-solution feed portion by the solution feeding assembly is prevented from flowing over the upper end of the guide portion because the solution in the solution feed portion is introduced into the solution recovery portion via the communicating portion.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Hereinafter, the apparatus and method for producing electrophotographic photoreceptor according to the preferred embodiments of the invention will be specifically described with reference to the accompanying drawings.

(First Embodiment)

Figure 2:
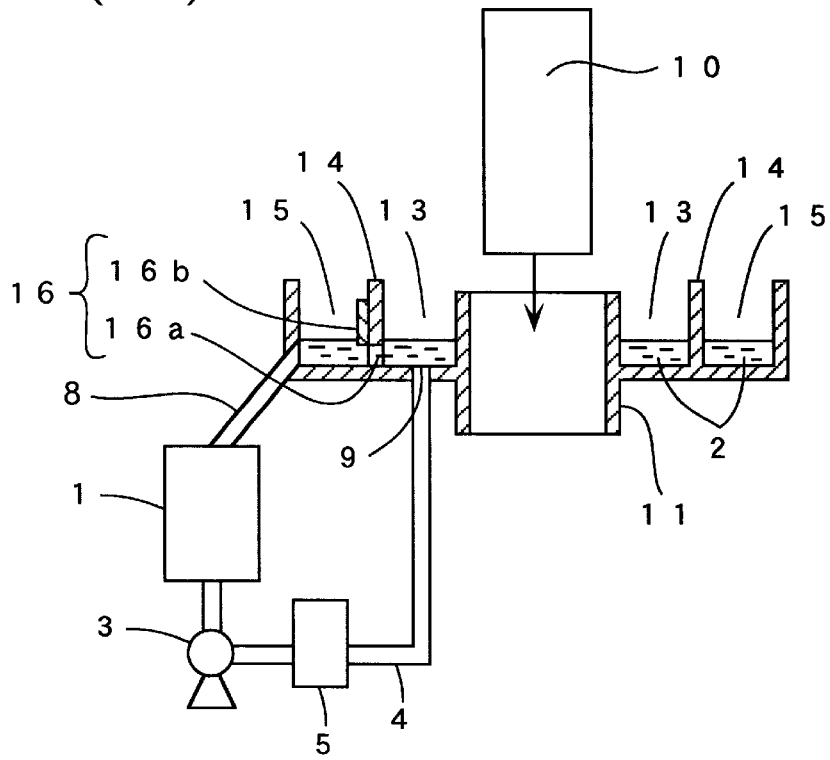
FIGS. 2(A) and 2(B) are schematic sectional views illustrating an apparatus and method for producing electrophotographic photoreceptor according to a first embodiment of the invention wherein the coating solution is applied to the outer periphery of the coated member by allowing the coating solution to flow over an upper end of a guide portion.
Figure 2:
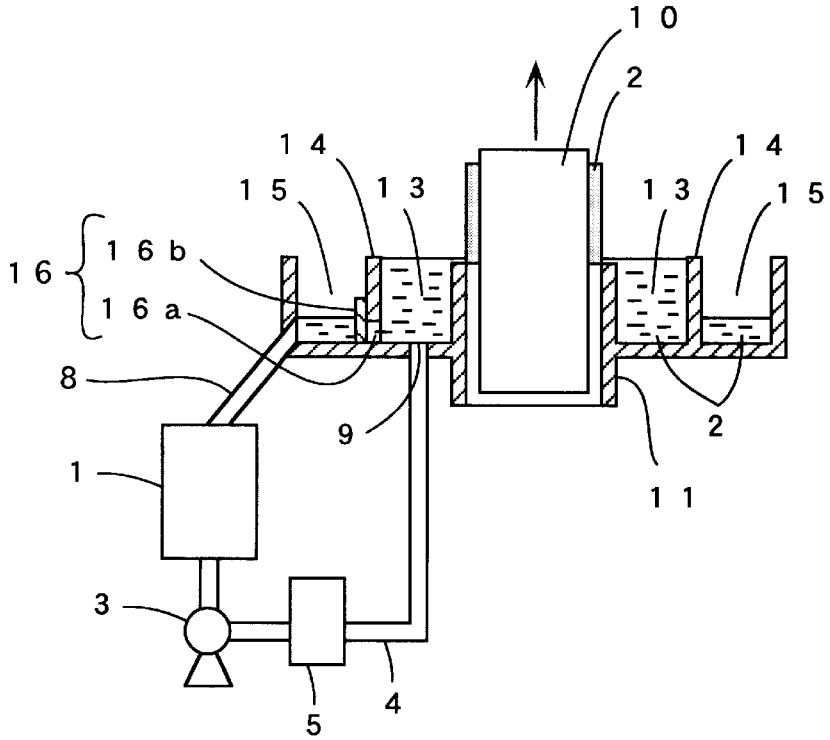

As shown in FIGS. 2(A) and 2(B), an apparatus for producing electrophotographic photoreceptor of a first embodiment has an arrangement wherein a guide portion 11 permitting passage of a cylindrical coated member 10 therethrough is formed in a cylindrical shape slightly greater in diameter than the coated member 10. A coating-solution feed portion 13 is disposed around an outer periphery of the guide portion 11. Furthermore, a coating-solution recovery portion 15 is disposed around an outer periphery of the coating-solution feed portion 13 via a partitioning wall 14 taller than an upper end of the guide portion 11.

As an openable communicating portion 16 for communication between the coating-solution feed portion 13 and the coating-solution recovery portion 15, there are provided a communicating hole 16*a* in the partitioning wall 14 between the solution feed portion 13 and the solution recovery portion 15, and a cover plate 16*b* serving to open or close the communicating hole 16*a*.

The coating solution 2 is fed to the coating-solution feed portion 13 in the following manner. The coating solution 2 contained in a tank 1 is introduced through a feed pipe 4 into a filter 5 by means of a pump 3. After removal of foreign substances by means of the filter 5, the coating solution 2 is pumped through the feed pipe 4 into the coating-solution feed portion 13 via a feed port 9. The coating solution 2 in the coating-solution recovery portion 15 is returned to the tank 1 via a return pipe 8 for recovery of the solution 2 from the solution recovery portion 15.

The apparatus of the first embodiment is in the following state prior to the application of the coating solution 2 to an outer periphery of the coated member 10. As shown in FIG. 2A, the communicating hole 16*a* in the partitioning wall 14 is opened, establishing the communication between the solution feed portion 13 and the solution recovery portion 15. This permits the coating solution 2 fed to the solution feed portion 13 to be introduced through the communicating hole 16*a* into the solution recovery portion 15 and then to be returned to the tank 1 via the return pipe 8 if the coating solution 2 in the tank 1 is pumped through the feed pipe 4 into the solution feed portion 13 via the feed port 9.

The coating solution 2 is applied to the outer periphery of the coated member 10 in the following manner. The coated member 10 is guidedly lowered into the guide portion 11 from thereabove to be set to place from which the application of the coating solution 2 is started. Subsequently, the communicating hole 16*a* for communication between the solution feed portion 13 and the solution recovery portion 15 is closed by the cover plate 16*b*.

With the communicating hole 16*a* thus closed, the coating solution 2 is accumulated in the solution feed portion 13 to gradually raise a liquid surface thereof, the pump 3 feeding the solution from the tank 1 through the feed pipe 4 into the solution feed portion 13 via the feed port 9. Eventually, the coating solution 2 in the solution feed portion 13 flows over the upper end of the guide portion 11 so that the overflow of the coating solution 2 is applied to the outer periphery of the coated member 10.

As shown in FIG. 2(B), the coated member 10 is raised at a predetermined rate in synchronism with the flow of the coating solution 2 from the solution feed portion 13 over the upper end of the guide portion 11 to be applied to the outer periphery of the coated member 10. In this manner, the outer periphery of the coated member 10 so raised is applied with the coating solution 2 flowing over the upper end of the guide portion 11.

If the coating solution 2 is excessively fed to the solution feed portion 13, an excessive coating solution 2 guidedly flows over the partitioning wall 14 into the solution recovery portion 15. The coating solution 2 thus guided into the solution recovery portion 15 is returned to the tank 1 via the return pipe 8 in the aforementioned manner.

At a point of time when the application of the coating solution 2 to the outer periphery of the coated member 10 is completed, the cover plate 16*b* closing the communicating hole 16*a* is returned to its initial position to open the communicating hole 16*a*.

With the communicating hole 16*a* thus opened, the coating solution 2 in the solution feed portion 13 is introduced into the solution recovery portion 15 via the communicating hole 16*a*. The coating solution 2 so introduced into the solution recovery portion 15 is returned to the tank 1 via the return pipe 8 in the aforementioned manner. Thus, the coating solution 2 in the solution feed portion 13 is prevented from flowing over the upper end of the guide portion 11.

The following advantages may be attained if, as suggested by the first embodiment, the coating solution 2 is allowed to flow from the solution feed portion 13, around the guide portion 11, over the upper end of the guide portion 11 for application thereof to the outer periphery of the cylindrical coated member 10 passed through the guide portion 11. The coating solution 2 is prevented from adhering to an inner periphery of the coated member 10. Besides, the embodiment negates the need for sealing the coated member 10 at its upper end, which is necessary where the conventional dip coating apparatus is used for applying the coating solution 2 to the outer periphery of the coated member 10.

The first embodiment eliminates the prior-art problem of the thickness nonuniformities in the coated layer which results from the entrance of air into the coating solution 2 applied to the coated member 10. The uniform application of the coating solution 2 to the outer periphery of the coated member is accomplished by properly adjusting the rate at which the coated member 10 is passed through the guide portion 11 or the viscosity of the coating solution 2. This contributes to the easy production of the electrophotographic photoreceptors with stable characteristics.

As mentioned supra, the first embodiment is designed such that the coating solution 2 is applied to the outer periphery of the coated member 10 passed through the guide portion 11 and hence, time taken to apply the coating solution 2 can be reduced. This leads to an improved productivity of the electrophotographic photoreceptors. In addition, even in a case where the formation of a first charge transport layer over the outer periphery of the coated member 10 is followed by the application of the coating solution 2 for second charge transport layer onto the first charge transport layer, the first charge transport layer is prevented from being dissolved by the coating solution 2 for second charge transport layer. Thus, the first and second charge transport layers are properly formed over the outer periphery of the coated member 10 so that the electrophotographic photoreceptor with excellent characteristics may readily be produced.

Figure 3:
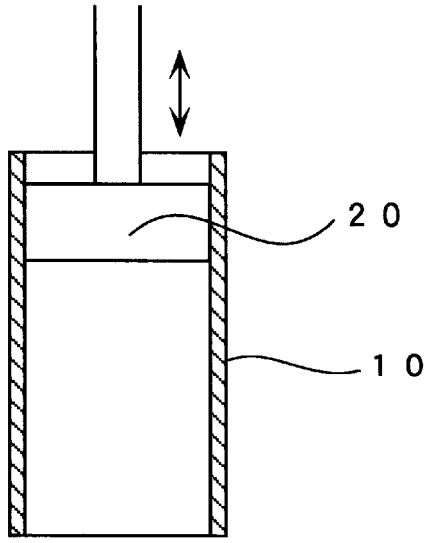
FIGS. 3(A) and 3(B) are schematic sectional views illustrating exemplary methods for vertically moving the coated member, the methods taken by the apparatus and process for electrophotographic photoreceptor fabrication according to the first embodiment.
Figure 3:
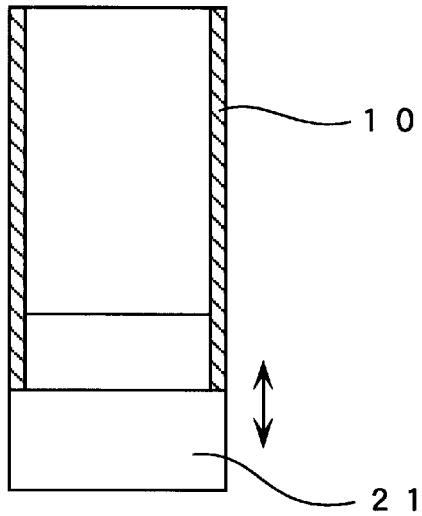

The following methods may be taken to guidingly lower the coated member 10 into the guide portion 11 from thereabove for setting the coated member 10 to position from which the application of the coating solution 2 is started or to raise the coated member 10 for application of the coating solution 2. As shown in FIG. 3(A), a retainer 20 may be inserted in the inner periphery of the coated member 10 such that the coated member 10 is vertically moved as retained by the retainer 20. Otherwise, the coated member 10 may be set on a bearer 21 so as to be vertically carried by the bearer 21, as shown in FIG. 3(B). Alternatively, both the retainer 20 and the bearer 21 may be employed for vertically moving the coated member 10.

Figure 4:
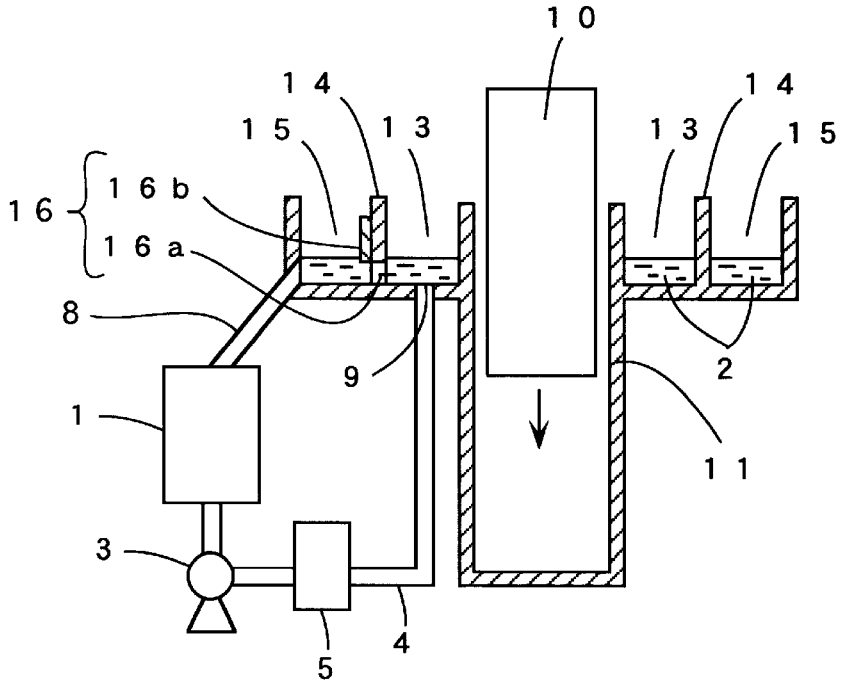
FIGS. 4(A) and 4(B) are schematic sectional views illustrating a modification of the apparatus and method for producing electrophotographic photoreceptor according to the first embodiment wherein the guide portion is modified to a cylindrical guide portion closed at bottom and slightly greater in diameter than the coated member.
Figure 4:
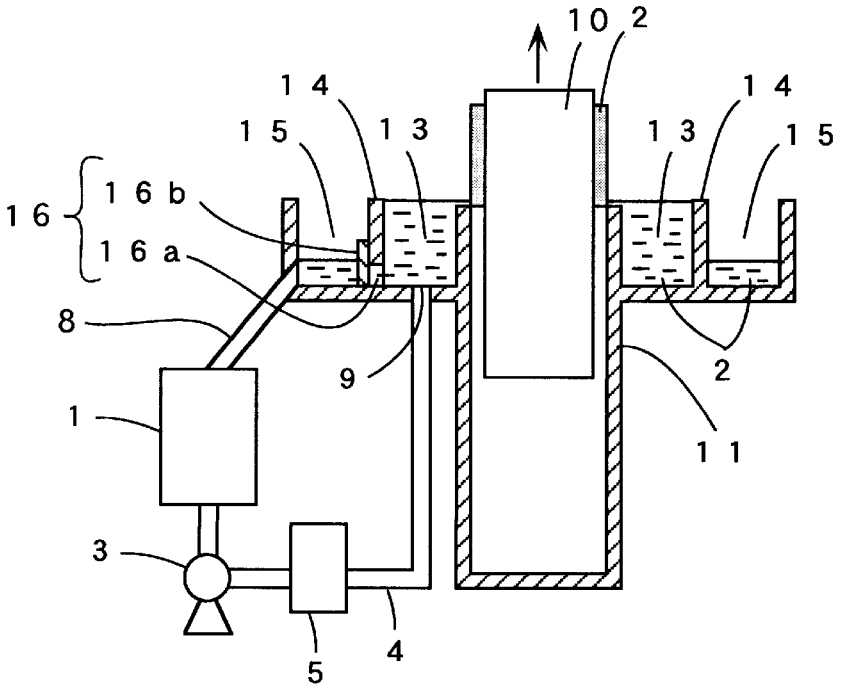

The apparatus according to the first embodiment employs the cylinder body slightly greater in diameter than the coated member 10 as the guide portion 11 permitting the passage of the cylindrical coated member 10 therethrough. Alternatively, the guide portion 11 may comprise a cylinder body closed at bottom and having a slightly greater diameter than the coated member 10, as shown in FIGS. 4(A) and 4(B). The use of the guide portion 11 closed at bottom has the following merit. Even if the coating solution 2 flowing from the solution feed portion 13 over the upper end of the guide portion 11 to be applied to the outer periphery of the coated member 10 should drip through a gap between the coated member 10 and the guide portion 11, the drip of solution 2 will be received by the bottom of the guide portion 11, as shown in FIG. 4(B). This prevents the solution from leaking outside and causing contamination.

Figure 5:
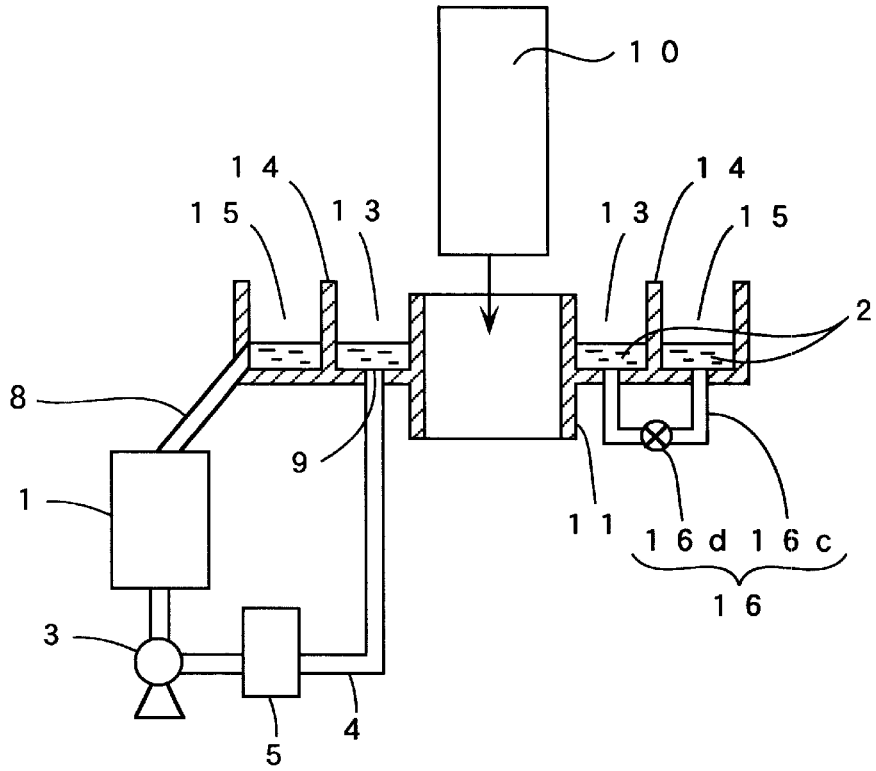
FIGS. 5(A) and 5(B) are schematic sectional views illustrating a modification of the apparatus and method for producing electrophotographic photoreceptor according to the first embodiment wherein the openable communicating portion for communication between the coating-solution feed portion and the coating-solution recovery portion comprises a communication pipe intercommunicating the coating-solution feed portion and the coating-solution recovery portion and a valve installed in the pipe.
Figure 5:
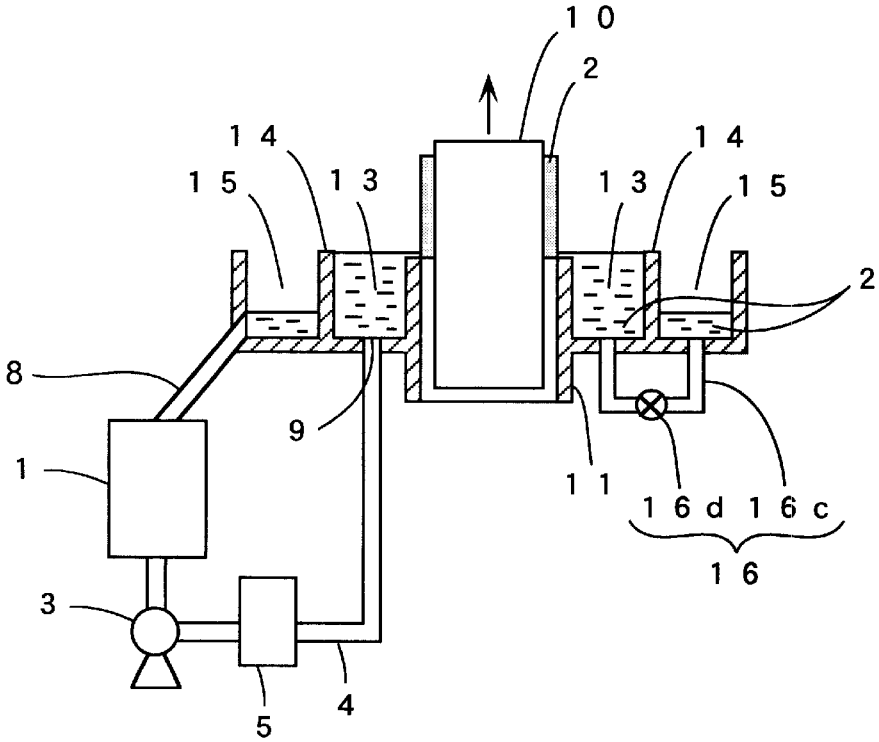

In the apparatus of the first embodiment, the openable communicating portion 16 for communication between the solution feed portion 13 and the solution recovery portion 15 includes the communicating hole 16*a* in the partitioning wall 14 between the solution feed portion 13 and the solution recovery portion 15, and the cover plate 16*b* operable to open or close the communicating hole 16*a*. As shown in FIGS. 5(A) and 5(B), an alternative arrangement may be made wherein a communicating pipe 16*c* is disposed for intercommunicating the solution feed portion 13 and the solution recovery portion 15 and a valve 16*d* is interposed in the communication pipe for opening or closing the communicating pipe 16*c*.

Figure 6:
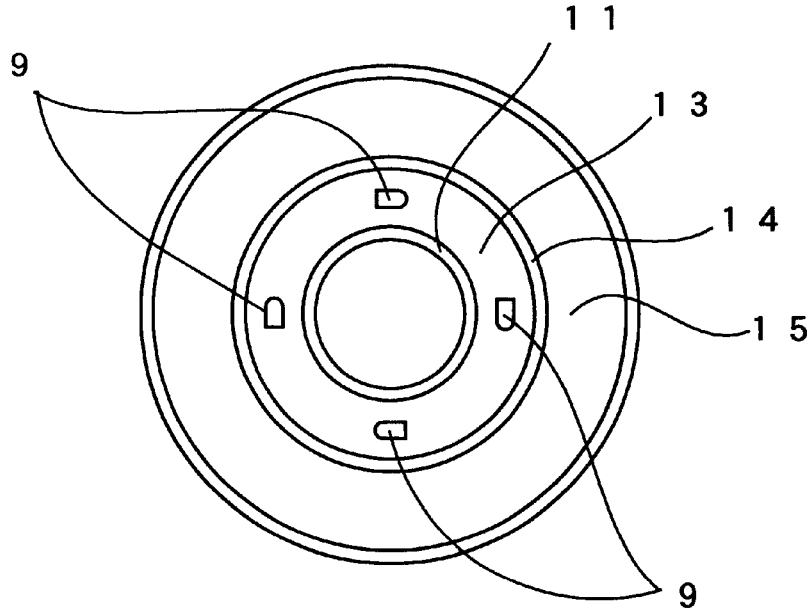
FIG. 6 is a schematic sectional view illustrating a modification of the apparatus and method for producing electrophotographic photoreceptor according to the first embodiment wherein the coating solution is introduced into the coating-solution feed portion via a plurality of feed pipes adapted to feed the solution circumferentially of the coating-solution feed portion thereby circulating the coating solution within the solution feed portion.

In the apparatus of the first embodiment, the coating solution 2 in the tank is pumped by the pump 3 through the feed pipe 4 into the solution feed portion 13 via only one feed port 9. As shown in FIG. 6, an alternative arrangement may be made wherein the coating solution 2 is introduced into the solution feed portion 13 through a plurality of feed ports 9, which direct a flow of the coating solution 2 circumferentially of the solution feed portion 13 thereby circulating the coating solution 2 within the solution feed portion 13. If circulated in the solution feed portion 13 in this manner, the coating solution 2 is properly stirred so that a homogeneous coating solution 2 may be applied to the outer periphery of the coated member 10.

(Second Embodiment)

Figure 7:
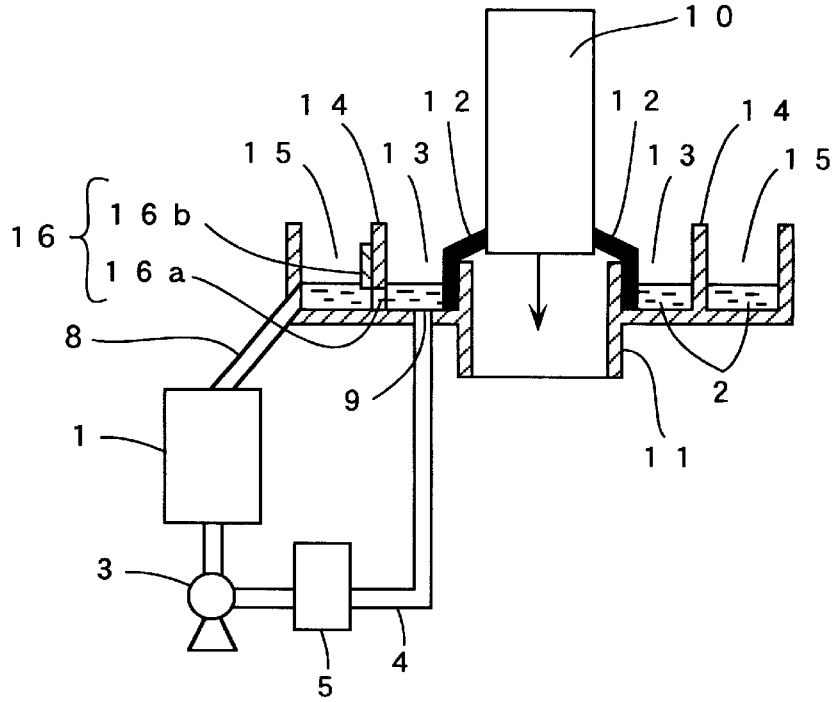
FIGS. 7(A) and 7(B) are schematic sectional views illustrating an apparatus and method for producing electrophotographic photoreceptor according to a second embodiment of the invention wherein a coating member extended from an upper end of the guide portion is allowed to contact the outer periphery of the coated member for applying thereto the coating solution.
Figure 7:
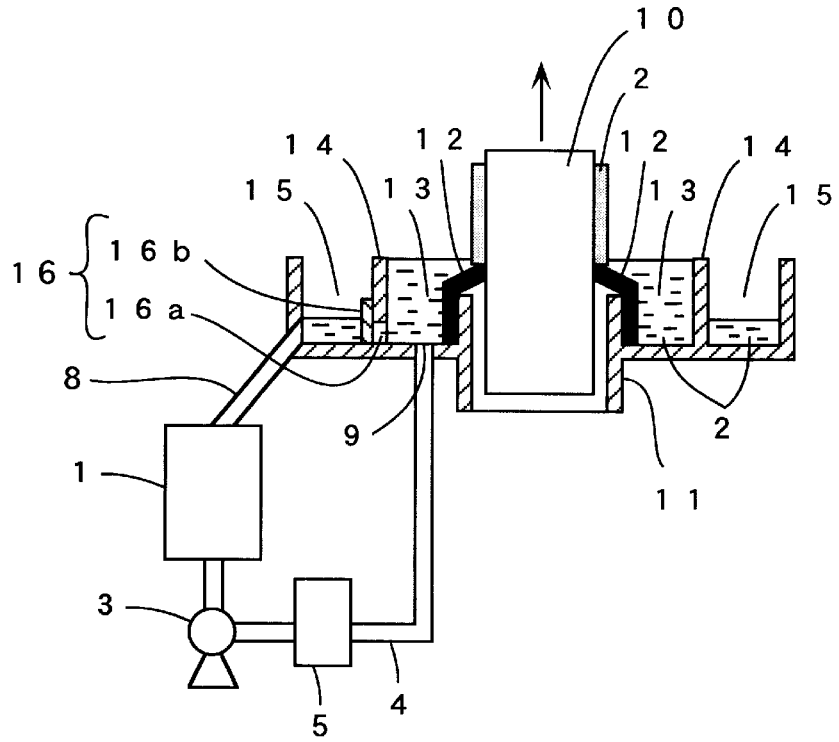

An apparatus for producing electrophotographic photoreceptor according to a second embodiment is arranged the same way as in the first embodiment except for the following points. As shown in FIGS. 7(A) and 7(B), the guide portion 11 permitting the passage of the cylindrical coated member 10 therethrough is formed in a cylinder shape slightly greater in diameter than the coated member 10 and is provided with a coating member 12 extended inwardly from the upper end of the guide portion 11 in a manner to be in contact with the outer periphery of the coated member 10 passed through the guide portion 11. On the other hand, the solution feed portion 13 is disposed around the outer periphery of the guide portion 11, whereas the solution recovery portion 15 is disposed around the outer periphery of the solution feed portion 13 via the partitioning wall 14 taller than an upper end of the coating member 12.

The apparatus of the second embodiment is also in the following state prior to the application of the coating solution 2 to the outer periphery of the coated member 10. As shown in FIG. 7(A), the communicating hole 16*a* in the partitioning wall 14 is opened for communication between the solution feed portion 13 and the solution recovery portion 15. In this state, the coating solution 2 in the tank 1 is fed through the feed pipe 4 into the solution feed portion 13 via the feed port 9 while the solution thus fed to the solution feed portion 13 is introduced through the communicating hole 16*a* into the solution recovery portion 15, from which the solution is returned to the tank 1 via the return pipe 8.

The coating solution 2 is applied to the coated member 10 in the following manner. The coated member 10 is guidedly lowered into the guide portion 11 from thereabove so as to be set to position from which the application of the coating solution is started. Subsequently, the communicating hole 16*a* for communication between the solution feed portion 13 and the solution recovery portion 15 is closed by means of the cover plate 16*b*.

With the communicating hole 16*a* thus closed, the coating solution 2 is accumulated in the solution feed portion 13 to gradually raise its liquid surface, the pump 3 feeding the solution from the tank 1 through the feed pipe 4 into the solution feed portion 13 via the feed port 9. Eventually, the level of the coating solution 2 in the solution feed portion 13 reaches the upper end of the coating member 12 extended inwardly from the upper end of the guide portion 11 so that the coating member 12 applies the coating solution 2 to the outer periphery of the coated member 10.

AS shown in FIG. 7(B), the coated member 10 is raised at a predetermined rate in synchronism with the feeding of the coating solution 2 onto the outer periphery of the coated member 10 by means of the coating member 12. In this manner, the coating member 12 applies the coating solution 2 to the outer periphery of the coated member 10 thus raised. The apparatus of the second embodiment is also arranged such that if the coating solution 2 is excessively fed to the solution feed portion 13, the excessive solution 2 guidedly flows over the partitioning wall 14 into the solution recovery portion 15, from which the solution is returned through the return pipe 8 to the tank 1 in the aforementioned manner.

The following advantages accrue from the apparatus of the second embodiment wherein the coating solution 2 is applied to the outer periphery of the coated member 10 by means of the coating member 12 allowed to contact the outer periphery of the coated member 10 passed through the guide portion 10. That is, the coating solution 2 is uniformly applied to the outer periphery of the coated member 10. Furthermore, even in a case where the coating solution 2 of a low viscosity is applied, the solution 2 is prevented from dripping through the gap between the coated member 10 and the guide portion 11.

The coating member 12 may preferably be formed of a resin material in the light of avoidance of damage to the outer periphery of the coated member 10 and to various layers laid over the outer periphery of the coated member 10. Particularly preferred is a fluorine plastic material excellent in solvent resistance, slip characteristics, wear resistance and the like. Examples of a suitable fluorine plastic for the coating member 12 include polytetrafluoroethylene, tetrafluoroethylene-perfluoroalkyl vinyl ether copolymer, tetrafluoroethylene-hexafluoropropylene copolymer, tetrafluoroethylene-ethylene copolymer, polychlorotrifluoroethylene, chlorotrifluoroethylene-ethylene copolymer, polyvinylidenefluoride, polyvinylfluoride and the like.

Figure 8:
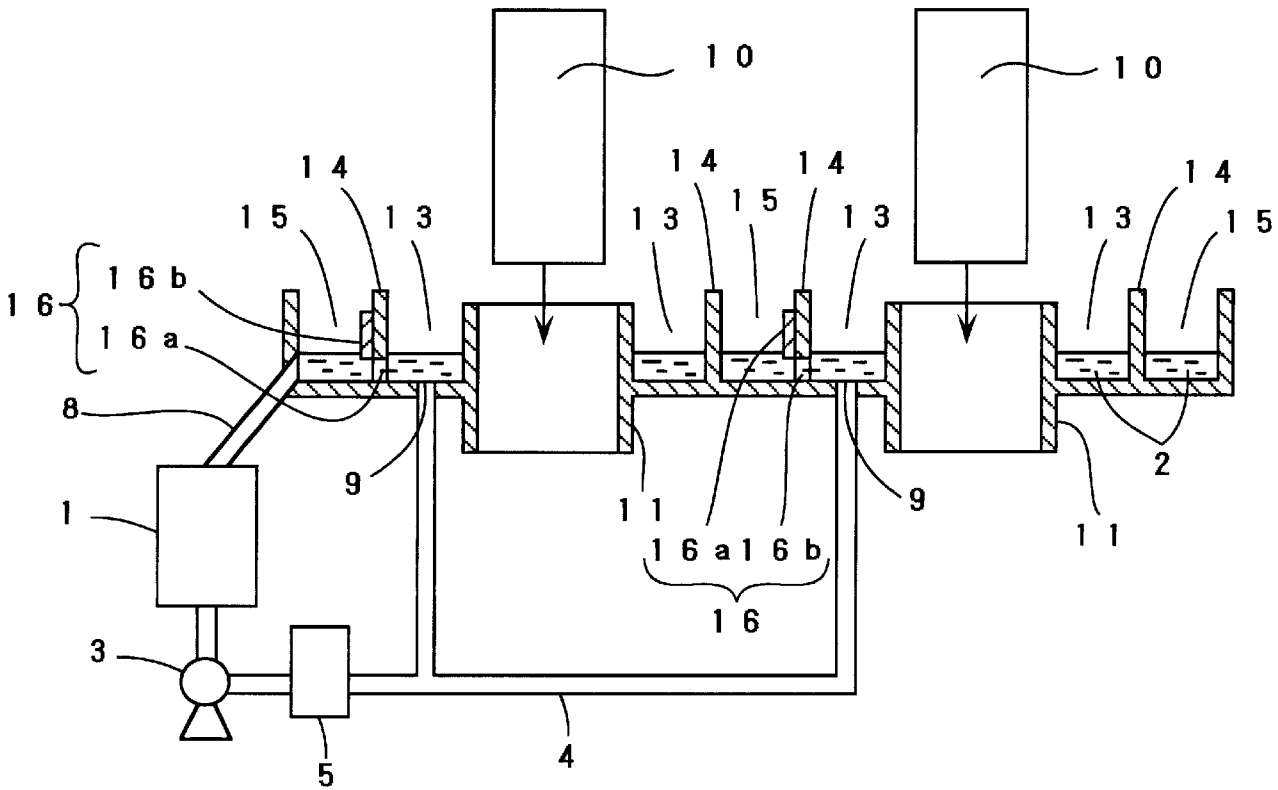
FIG. 8 is a schematic sectional view illustrating an exemplary apparatus and method for producing electrophotographic photoreceptor according to an embodiment of the invention wherein a plurality of guide portions and coating-solution feed portions are provided for collective application of the coating solution to the outer peripheries of plural coated members.
Figure 9:
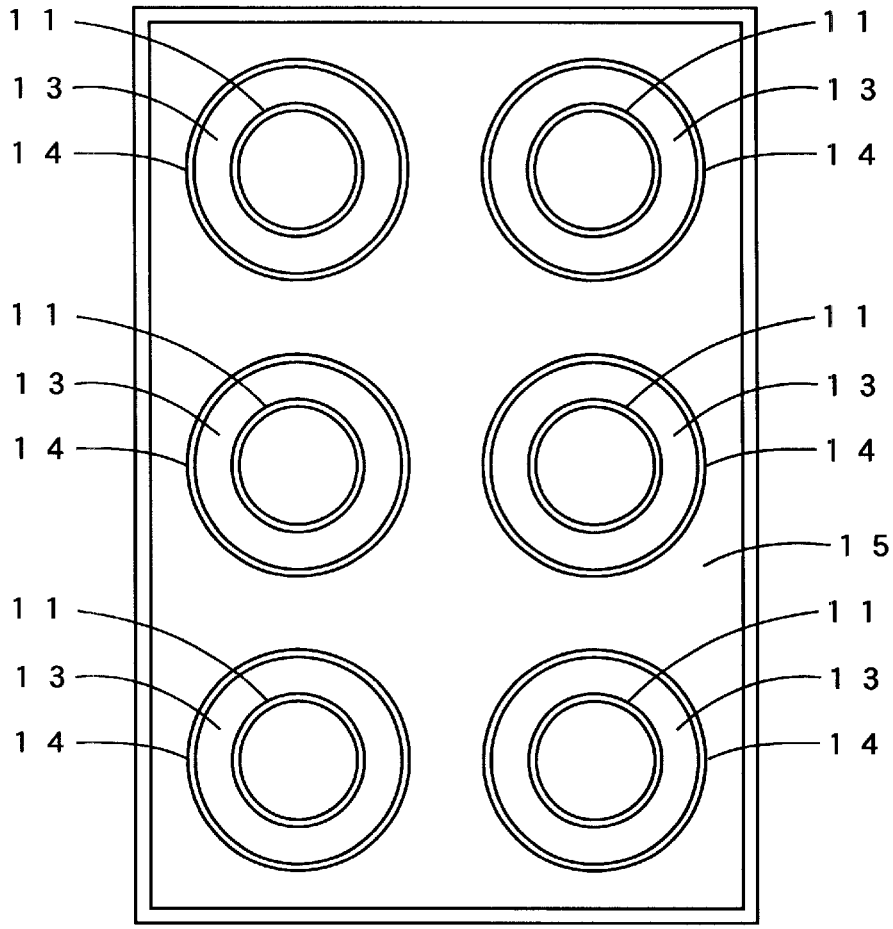
FIG. 9 is a schematic plan view illustrating the apparatus and method for producing electrophotographic photoreceptor according to the embodiment wherein a plurality of guide portions and coating-solution feed portions are provided for collective application of the coating solution to the outer peripheries of plural coated members.

The apparatuses of the first and second embodiments each include one guide portion 11, one solution feed portion 13 and one solution recovery portion 15 for applying the coating solution 2 to the outer periphery of the coated member 10 on a one-by-one basis. As shown in FIGS. 8 and 9, an alternative arrangement may be made such that plural guide portions 11 and solution feed portions 13 are provided whereas the solution recovery portion 15 is disposed around the respective outer peripheries of the solution feed portions 13 so as to be shared by them. This arrangement permits the coating solution 2 to be collectively applied to the outer peripheries of plural coated members 10 individually guided into the respective guide portions 11.

In the apparatuses of the above embodiments, the type of the coating solution 2 applied to the outer periphery of the coated member 10 is not particularly limited so long as it is used in the production of the electrophotographic photoreceptor. The apparatuses of the invention are adapted for application of a variety of coating solutions for layer formations, which include: a photosensitive layer coating solution used for fabricating an electrophotographic photoreceptor with a single-layered photosensitive layer; a charge-generating layer coating solution and a charge-transport layer coating solution used for fabricating a multilayered electrophotographic photoreceptor with laminations of a charge generating layer and a charge transport layer; a first charge-transport layer coating solution and a second charge-transport layer coating solution used for forming first and second charge transport layers; and various types of coating solutions used for laying over the electrophotographic photoreceptor an undercoat layer, intermediate layer, top-coat layer and the like.

The viscosity of the coating solution 2 applied to the outer periphery of the coated member 10 is not particularly limited. However, a coating solution 2 too low in viscosity is hard to apply to the outer periphery of the coated member 10. If, on the other hand, the coating solution 2 is too viscous, it is difficult to control a coat of the coating solution 2 over the outer periphery of the coated member 10 to a proper thickness. Therefore, it is a general practice to use the coating solution with viscosity in the range of 0.1 to 500 cp and preferably of 1 to 300 cp.

In the case of the first embodiment wherein the guide portion 11 slightly greater in diameter than the coated member 19 is employed for applying to the outer periphery of the coated member 10 the coating solution 2 flowing over the upper end of the guide portion 11, there is a fear of the dripping of the coating solution 2 through the gap between the coated member 10 and the guide portion 11 if the gap therebetween is too great or the coating solution 2 is too low in viscosity.

Accordingly, where a coating solution 2 of low viscosity of not more than 100 cp is used, it is preferred to provide the coating member 12 in contacting relation with the outer periphery of the coated member 10 passed through the guide portion 11 such that coating member 12 may apply the coating solution 2 to the outer periphery of the coated member 10, as suggested by the second embodiment. Where the coating solution 2 is applied to the outer periphery of the coated member 10 by means of the coating member 12 allowed to contact therewith, it is preferred to use the coating solution of low viscosity of 1 to not more than 50 cp or preferably of 2 to not more than 20 cp in the light of the uniform application of the coating solution 2 to the outer periphery of the coated member 10 and an increased productivity.

Next, comparison is made between inventive examples and comparative examples for clarifying advantages accrued from the inventive examples. The inventive examples took the procedures of the foregoing embodiments to apply a second charge-transport layer coating solution to an outer periphery of a conductive substrate formed with a charge generating layer and a first charge transport layer. In the comparative examples, the second charge-transport layer coating solution was applied in the conventional manner as shown in FIGS. 1(A) and 1(B).

In the following examples and comparative examples, a cylindrical aluminum tube having an outside diameter of 80 mm and a length of 350 mm was used as the conductive substrate, which was formed with the charge generating layer and the first charge transport layer on its outer periphery.

The charge generating layer was laid over the outer periphery of the conductive substrate as follows. A charge-generating layer coating solution was prepared by admixing 100 parts by weight of tetrahydrofuran with 1 part by weight of butyral resin (S-Lec BX-1 commercially available from Sekisui Chemical Co., Ltd.) and 1 part by weight of M-type titanylphthalocyanine (am-TiOPC commercially available from Toyo Ink Mfg. Co., Ltd.) and dispersing the resultant mixture for five hours by means of a sand mill.

The conductive substrate was dipped in and withdrawn from the charge-generating layer coating solution so prepared, thereby applying the solution to the outer periphery of the conductive substrate. Then, the resultant wet layer on the substrate was dried to form thereon the 0.2-$\mu$m thick charge generating layer.

The first charge transport layer was laid over the outer periphery of the conductive substrate formed with the charge generating layer as follows. A first charge-transport layer coating solution was prepared by dissolving 10 parts by weight of polycarbonate resin (Panlight K-1300 commercially available from Teijin Chemical Ltd.), 10 parts by weight of charge transport material represented by the following chemical formula 1, and 0.005 parts by weight of leveling agent (KF50 commercially available from Shin-Etsu Chemical Co., Ltd.) into 100 parts by weight of tetrahydrofuran.

(1)

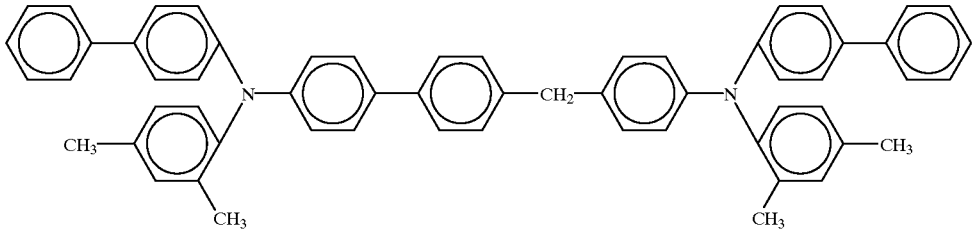

The conductive substrate thus formed with the charge generating layer was dipped in and withdrawn from the first charge-transport layer coating solution, thereby applying the first charge-transport layer coating solution to the outer periphery of the conductive substrate formed with the charge generating layer. The resultant wet layer on the substrate was dried to form thereon the 20-$\mu$m thick first charge transport layer.

EXAMPLE 1

Example 1 used the following second charge-transport layer coating solution for forming a second charge transport layer on the outer periphery of the conductive substrate thus formed with the charge generating layer and first charge transport layer.

The second charge-transport layer coating solution was prepared as follows. A solution was prepared by dissolving 10 parts by weight of polycarbonate resin (Panlight K-1300 commercially available from Teijin Chemical Ltd.), 10 parts by weight of charge transport material of the above chemical formula 1, and 0.005 parts by weight of leveling agent (KF50 commercially available from Shin-Etsu Chemical Co., Ltd.) in 400 parts by weight of tetrahydrofuran. A dispersion of fluorine particles was prepared by ultrasonically dispersing 10 parts by weight of fluorine particles (Lubron L-2 commercially available from Daikin Industries, Ltd.) in 100 parts by weight of tetrahydrofuran for 30 minutes. The dispersion of fluorine particles was admixed to the above solution and was ultrasonically dispersed therein for 30 minutes. Thus was obtained the second charge-transport layer coating solution having a viscosity of 4 cp.

Example 1 used the apparatus of the second embodiment shown in FIGS. 7(A) and 7(B) wherein the coating member was allowed to contact the outer periphery of the conductive substrate formed with the charge generating layer and the first charge transport layer. The conductive substrate was raised at a rate of 10 mm/s with the coating member applying thereto the second charge-transport layer solution. subsequently, the resultant wet layer was dried at 100° C. for 40 minutes to form the 2-$\mu$m thick second charge transport layer on the first charge transport layer. Thus was obtained an electrophotographic photoreceptor with laminations of the charge generating layer, first charge transport layer and second charge transport layer formed on its outer periphery.

EXAMPLE 2

Example 2 used the following second charge-transport layer coating solution for forming a second charge transport layer on the outer periphery of the conductive substrate formed with the charge generating layer and first charge transport layer. The second charge-transport layer coating solution was prepared by dissolving 10 parts by weight of polycarbonate resin-(Panlight K-1300 commercially available from Teijin Chemical Ltd.), 5 parts by weight of charge transport material of the above chemical formula 1, and 0.005 parts by weight of leveling agent (KF50 commercially available from Shin-Etsu Chemical Co., Ltd.) in 400 parts by weight of tetrahydrofuran. The resultant second charge-transport layer coating solution had a viscosity of 10 cp.

Example 2 also used the apparatus of the second embodiment shown in FIGS. 7(A) and 7(B) wherein the coating member was allowed to contact the outer periphery of the conductive substrate formed with the charge generating layer and the first charge transport layer. The conductive substrate was raised at a rate of 8 mm/s with the coating member applying thereto the second charge-transport layer solution. Subsequently, the resultant wet layer was dried at 100° C. for 40 minutes to form the 3-$\mu$m thick second charge transport layer on the first charge transport layer. Thus was obtained an electrophotographic photoreceptor with laminations of the charge generating layer, fist charge transport layer and second charge transport layer formed on its outer periphery.

EXAMPLE 3

Example 3 used the following second charge-transport layer coating solution for forming a second charge transport layer on the outer periphery of the conductive substrate formed with the charge generating layer and first charge transport layer. The second charge-transport layer coating solution was prepared by dissolving 10 parts by weight of Z-type polycarbonate resin (Panlight TS-2050 commercially available from Teijin Chemical Ltd.), 5 parts by weight of charge transport material of the above chemical formula 1, and 0.005 parts by weight of leveling agent (KF50 commercially available from Shin-Etsu Chemical Co., Ltd.) in 400 parts by weight of tetrahydrofuran. The resultant second charge-transport layer coating solution had a viscosity of 15 cp.

Example 3 also used the apparatus of the second embodiment shown in FIGS. 7(A) and 7(B) wherein the coating member was allowed to contact the outer periphery of the conductive substrate formed with the charge generating layer and the first charge transport layer. The conductive substrate was raised at a rate of 8 mm/s with the coating member applying thereto the second charge-transport layer solution. Subsequently, the resultant wet layer was dried at 100° C. for 40 minutes to form the 4-$\mu$m thick second charge transport layer on the first charge transport layer. Thus was obtained an electrophotographic photoreceptor with laminations of the charge generating layer, fist charge transport layer and second charge transport layer formed on its outer periphery.

EXAMPLE 4

Example 4 used the following second charge-transport layer coating solution for forming a second charge transport layer on the outer periphery of the conductive substrate formed with the charge generating layer and first charge transport layer. The second charge-transport layer coating solution was prepared by dissolving 50 parts by weight of polycarbonate resin (Panlight K-1300 commercially available from Teijin Chemical Ltd.), 5 parts by weight of charge transport material of the above chemical formula 1, and 0.005 parts by weight of leveling agent (KF50 commercially available from Shin-Etsu Chemical Co., Ltd.) in 400 parts by weight of tetrahydrofuran. The resultant second charge-transport layer coating solution had a viscosity of 120 cp.

Example 4 used the apparatus of the first embodiment shown in FIGS. 2(A) and 2(B) wherein the conductive substrate was raised at a rate of 5 mm/s while the above second charge-transport layer coating solution was caused to flow over the upper end of the guide portion for application of the solution to the outer periphery of the conductive substrate thus formed with the charge generating layer and first charge transport layer. Subsequently, the resultant wet layer was dried at 100° C. for 40 minutes to form the 10-$\mu$m thick second charge transport layer on the first charge transport layer. Thus was obtained an electrophotographic photoreceptor with laminations of the charge generating layer, first charge transport layer and second charge transport layer formed on its outer periphery.

EXAMPLE 5

Example 5 used the following second charge-transport layer coating solution for forming a second charge transport layer on the outer periphery of the conductive substrate formed with the charge generating layer and first charge transport layer. The second charge-transport layer coating solution was prepared by dissolving 50 parts by weight of Z-type polycarbonate resin (Panlight TS-2050 commercially available from Teijin Chemical Ltd.), 5 parts by weight of charge transport material of the above chemical formula 1, and 0.005 parts by weight of leveling agent (KF50 commercially available from Shin-Etsu Chemical Co., Ltd.) in 400 parts by weight of tetrahydrofuran. The resultant second charge-transport layer coating solution had a viscosity of 200 cp.

Example 5 also used the apparatus of the first embodiment shown in FIGS. 2(A) and 2(B) wherein the conductive substrate was raised at a rate of 3 mm/s while the above second charge-transport layer coating solution was caused to flow over the upper end of the guide portion for application of the solution to the outer periphery of the conductive substrate formed with the charge generating layer and first charge transport layer. Subsequently, the resultant wet layer was dried at 100° C. for 40 minutes to form the 10-μm thick second charge transport layer on the first charge transport layer. Thus was obtained an electrophotographic photoreceptor with laminations of the charge generating layer, first charge transport layer and second charge transport layer formed on its outer periphery.

EXAMPLE 6

Example 6 used the following second charge-transport layer coating solution for forming a second charge transport layer on the outer periphery of the conductive substrate formed with the charge generating layer and first charge transport layer. The second charge-transport layer coating solution was prepared by dissolving 30 parts by weight of Z-type polycarbonate resin (Panlight TS-2050 commercially available from Teijin Chemical Ltd.), 5 parts by weight of charge transport material of the above chemical formula 1, and 0.005 parts by weight of leveling agent (KF50 commercially available from Shin-Etsu Chemical Co., Ltd.) in 400 parts by weight of tetrahydrofuran. The resultant second charge-transport layer coating solution had a viscosity of 80 cp.

Example 6 also used the apparatus of the first embodiment shown in FIGS. 2(A) and 2(B) wherein the conductive substrate was raised at a rate of 8 mm/s while the above second charge-transport layer coating solution was caused to flow over the upper end of the guide portion for application of the solution to the outer periphery of the conductive substrate formed with the charge generating layer and first charge transport layer. Subsequently, the resultant wet layer was dried at 100° C. for 40 minutes to form the 10-μm thick second charge transport layer on the first charge transport layer. Thus was obtained an electrophotographic photoreceptor with laminations of the charge generating layer, first charge transport layer and second charge transport layer formed on its outer periphery.

COMPARATIVE EXAMPLE 1

Comparative Example 1 used the following second charge-transport layer coating solution for forming a second charge transport layer on the outer periphery of the conductive substrate formed with the charge generating layer and first charge transport layer. The second charge-transport layer coating solution was prepared the same way as in Example 1 and had a viscosity of 4 cp. comparative Example 1 used the apparatus shown in FIGS. 1(A) and 1(B) wherein the second charge-transport layer coating solution was contained in the dip coating vessel. The above conductive substrate was dipped in the dip coating vessel and then withdrawn therefrom at a rate of 10 mm/s for application of the solution to the outer periphery of the conductive substrate formed with the charge generating layer and the first charge transport layer. Subsequently, the resultant wet layer was dried at 100° C. for 40 minutes to form the 2-μm thick second charge transport layer on the first charge transport layer. Thus was obtained an electrophotographic photoreceptor with laminations of the charge generating layer, first charge transport layer and second charge transport layer formed on its outer periphery.

COMPARATIVE EXAMPLE 2

Comparative Example 2 used the following second charge-transport layer coating solution for forming a second charge transport layer on the outer periphery of the conductive substrate formed with the charge generating layer and first charge transport layer. The second charge-transport layer coating solution was prepared the same way as in Example 2 and had a viscosity of 10 cp.

Similarly to Comparative Example 1, Comparative Example 2 used the apparatus shown in FIGS. 1(A) and 1(B) wherein the second charge-transport layer coating solution was contained in the dip coating vessel. The above conductive substrate was dipped in the dip coating vessel and then withdrawn therefrom at a rate of 8 mm/s for application of the solution to the outer periphery of the conductive substrate formed with the charge generating layer and the first charge transport layer. Subsequently, the resultant wet layer was dried at 100° C. for 40 minutes to form the 3-μm thick second charge transport layer on the first charge transport layer. Thus was obtained an electrophotographic photoreceptor with laminations of the charge generating layer, first charge transport layer and second charge transport layer formed on its outer periphery.

COMPARATIVE EXAMPLE 3

Comparative Example 3 used the following second charge-transport layer coating solution for forming a second charge transport layer on the outer periphery of the conductive substrate formed with the charge generating layer and first charge transport layer. The second charge-transport layer coating solution was prepared the same way as in Example 3 and had a viscosity of 15 cp.

Figure 1:
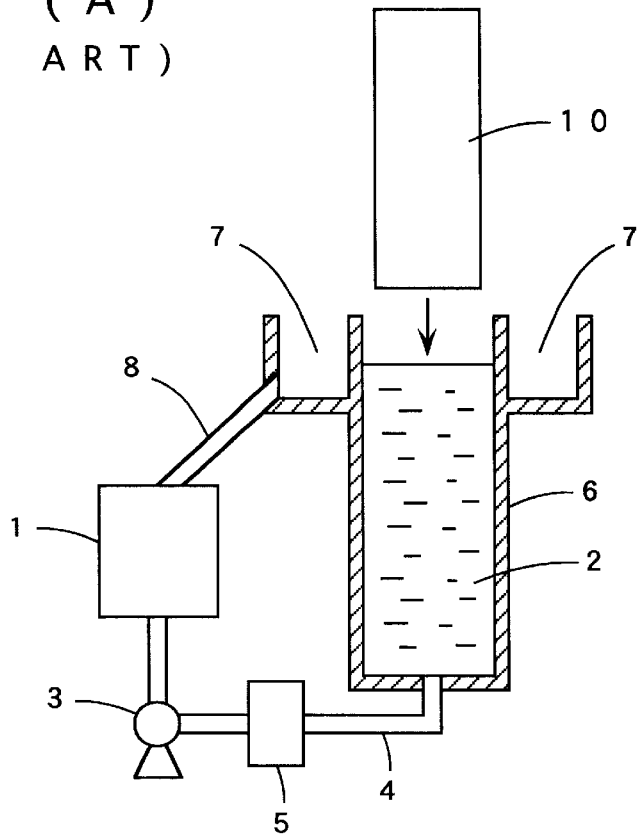
Fig 1 (A) (PRIOR ART)
FIGS. 1(A) and 1(B) are schematic sectional views illustrating a conventional apparatus and method for producing electrophotographic photoreceptor wherein a coating solution is applied to an outer periphery of a coated member by dipping the coated member in the coating solution fed to a dip coating vessel.
Figure 1:
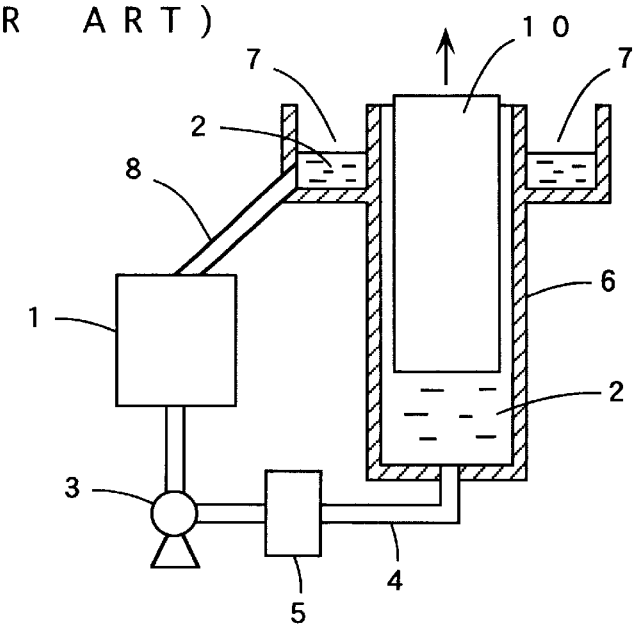
Fig 1 (B) (PRIOR ART)

Similarly to Comparative Example 1, Comparative Example 3 used the apparatus shown in FIGS. 1 (A) and 1(B) wherein the second charge-transport layer coating solution was contained in the dip coating vessel. The above conductive substrate was dipped in the dip coating vessel and then withdrawn therefrom at a rate of 8 mm/s for application of the solution to the outer periphery of the conductive substrate formed with the charge generating layer and the first charge transport layer. Subsequently, the resultant wet layer was dried at 100° C. for 40 minutes to form the 4-μm thick second charge transport layer on the first charge transport layer. Thus was obtained an electrophotographic photoreceptor with laminations of the charge generating layer, first charge transport layer and second charge transport layer formed on its outer periphery.

The states of coats formed from the second charge-transport layer solutions in Examples 1 to 6 and Comparative Examples 1 to 3 were each evaluated by visual check. In addition, each of the electrophotographic photoreceptors of Examples 1 to 6 and Comparative Examples 1 to 3 was mounted to a digital copier (Di30 commercially available from Minolta Co., Ltd.) to form a halftone image. The resultant halftone images thus obtained were evaluated. The results are tabulated in Table 1 as below.

The evaluation of the states of coats formed by applying the second charge-transport coating solutions is shown as follows: a coat formed through a uniform application of the solution without dissolving the first charge transport layer is represented by ○; a practically acceptable coat formed through application of the solution causing some of the first charge transport layer to run is represented by Δ; and a coat formed through application of the solution suffering the run of the dissolved first charge transport layer is represented by ×.

As to the evaluation of the halftone images, an image free from density variations is represented by ○; a practically acceptable image with minor density variations is represented by Δ; and an image with density variations resulting from the run of the dissolved first charge transport layer is represented by ×.

TABLE 1

| | EVALUATION OF STATE OF COAT | EVALUATION OF HALFTONE IMAGE |
|---|---|---|
| Example 1 | ○ | ○ |
| Example 2 | ○ | ○ |
| Example 3 | ○ | ○ |
| Example 4 | ○ | ○ |
| Example 5 | ○ | ○ |
| Example 6 | Δ | Δ |
| Comparative Example 1 | X | X |
| Comparative Example 2 | X | X |
| Comparative Example 3 | X | X |

As apparent from the results, the production of the electrophotographic photoreceptor through application of the second charge-transport layer coating solution according to the first or second embodiment suffers less dissolution and run of the first charge transport layer than the production of the electrophotographic photoreceptor through application of the solution as shown in FIGS. 1 (A) and 1(B), the solution applied to the outer periphery of the conductive substrate formed with the charge generating layer and the first charge transport layer. Furthermore, the reduction of density variations is accomplished by the halftone image formed using the electrophotographic photoreceptor of the first or second embodiment. Particularly where the second charge-transport layer solution is applied by means of the coating member allowed to contact the outer periphery of the conductive substrate formed with the charge generating layer and the first charge transport layer, even a second charge-transport layer solution of a low viscosity is uniformly applied without suffering the run of solution. Thus, the second charge transport layer is uniformly laid, contributing an electrophotographic photoreceptor with more preferred characteristics.

Although the present invention has been fully described by way of examples, it is to be noted that various changes and modifications will be apparent to those skilled in the art. Therefore, unless otherwise such changes and modifications depart from the scope of the present invention, they should be construed as being included therein.

What is claimed is:

1. An apparatus for producing electrophotographic photoreceptor comprising:

a guide portion permitting passage of a cylindrical coated member therethrough;

a coating-solution feed portion disposed around an outer periphery of the guide portion and allowing a coating solution to flow over an upper end of the guide portion thereby applying the coating solution to an outer periphery of the coated member thereby producing an electrophotographic photoreceptor;

a coating-solution feeding assembly for feeding the coating solution to the coating-solution feed portion;

a coating-solution recovery portion disposed around an outer periphery of the coating-solution feed portion via a partitioning wall for recovery of the coating solution flowing from the coating-solution feed portion over the partitioning wall; and an openable communicating portion for communication between the coating-solution feed portion and the coating-solution recovery portion.

2. The apparatus as claimed in claim 1, wherein a gap exists between said guide portion and the outer periphery of the coated member passed through the guide portion.

3. The apparatus as claimed in claim 1, further comprising a coating member allowed to contact the outer periphery of the coated member passed through said guide portion for applying thereto the coating solution.

4. The apparatus as claimed in claim 3, wherein the coating solution has a viscosity of 0.1 to 100 cp.

5. The apparatus as claimed in claim 4, wherein the coating solution has a viscosity of 1 to 20 cp.

6. The apparatus as claimed in claim 1, further comprising an open/close member operable to close said communicating portion when the coating solution is applied to said coated member and to open said communicating portion when the coating solution is not applied to said coated member.

7. The apparatus as claimed in claim 1, wherein an upper end of said partitioning wall is as high as or higher than the upper end of the guide portion.

8. The apparatus as claimed in claim 1, wherein said coating-solution feed portion is provided with a plurality of feed ports for the coating solution.

9. The apparatus as claimed in claim 8, wherein the coating solution is fed through said plural feed ports as directed circumferentially of the coating-solution feed portion.

10. An apparatus for producing electrophotographic photoreceptor comprising:

a first guide portion permitting passage of a first cylindrical coated member;

a first coating-solution feed portion disposed around an outer periphery of said first guide portion and allowing a coating solution to flow over an upper end of said first guide portion thereby applying the coating solution to an outer periphery of the first coated member thereby producing a first electrophotographic receptor;

a second guide portion permitting passage of a second cylindrical coated member;

a second coating-solution feed portion disposed around an outer periphery of the second guide portion and allowing the coating solution to flow over an upper end of the second guide portion thereby applying the coating solution to an outer periphery of the second coated member thereby producing a second electrophotographic receptor;

a coating-solution feeding assembly for feeding the coating solution to the first and second coating-solution feed portions;

a coating-solution recovery portion disposed around an outer periphery of the first coating-solution feed portion via a first partitioning wall and around an outer periphery of the second coating-solution feed portion via a second partitioning wall for recovery of the coating solution flowing from the first coating-solution feed portion over the first partitioning wall and from the second coating-solution feed portion over the second partitioning wall;

a first openable communicating portion for communication between the first coating-solution feed portion and the coating-solution recovery portion; and a second openable communicating portion for communication between the second coating-solution feed portion and the coating-solution recovery portion.

11. The apparatus as claimed in claim 10, wherein a gap exists between said first guide portion and the outer periphery of the coated member passed through the first guide portion and between said second guide portion and the outer periphery of the coated member passed through the second guide portion.

12. The apparatus as claimed in claim 10, further comprising a first coating member allowed to contact the outer periphery of the coated member passed through said first guide portion for applying thereto the coating solution, and a second coating member allowed to contact the outer periphery of the coated member passed through said second guide portion for applying thereto the coating solution.

13. The apparatus as claimed in claim 10, wherein an upper end of said first partitioning wall is as high as or higher than the upper end of the first guide portion, and wherein an upper end of said second partitioning wall is as high as or higher than the upper end of the second guide portion.

14. The apparatus as claimed in claim 10, wherein said first and second coating-solution feed portions are each provided with a plurality of feed ports for the coating solution.

15. The apparatus as claimed in claim 14, wherein the coating solution is fed through said plural feed ports as directed circumferentially of each of the first and second coating solution feed portions.

* * * * *